US008256550B2

(12) United States Patent
Huang et al.

(10) Patent No.: US 8,256,550 B2
(45) Date of Patent: Sep. 4, 2012

(54) COOLING DEVICE FOR VEHICLE

(75) Inventors: Song Huang, Wuhan (CN); Mannian Xu, Wuhan (CN); Zhenxiao Wang, Wuhan (CN)

(73) Assignee: Dongfeng Motor Corporation, Wuhan (CN)

( * ) Notice: Subject to any disclaimer, the term of this patent is extended or adjusted under 35 U.S.C. 154(b) by 839 days.

(21) Appl. No.: 12/394,505

(22) Filed: Feb. 27, 2009

(65) Prior Publication Data

US 2009/0159352 A1 Jun. 25, 2009

Related U.S. Application Data

(63) Continuation of application No. PCT/CN2007/002673, filed on Sep. 10, 2007.

(30) Foreign Application Priority Data

Dec. 30, 2006 (CN) ..... 2006 1 0166571

(51) Int. Cl.
*B60K 11/00* (2006.01)

(52) U.S. Cl. ..... 180/68.1; 180/383

(58) Field of Classification Search ..... 180/68.1, 180/68.2, 68.3, 383; 123/41.44, 41.49
See application file for complete search history.

(56) References Cited

U.S. PATENT DOCUMENTS

| | | | | |
|---|---|---|---|---|
| 2,057,637 | A * | 10/1936 | Schneider | 310/52 |
| 2,115,124 | A * | 4/1938 | Schittke | 123/41.49 |
| 2,155,287 | A * | 4/1939 | Wolf | 180/69.6 |
| 2,317,324 | A * | 4/1943 | Wolf | 180/69.6 |
| 3,995,603 | A * | 12/1976 | Thien et al. | 123/41.51 |
| 4,607,714 | A * | 8/1986 | Uttenthaler | 180/68.1 |
| 2002/0038734 | A1 * | 4/2002 | Yamauchi | 180/68.1 |

* cited by examiner

*Primary Examiner* — J. Allen Shriver, II
*Assistant Examiner* — Bridget Avery
(74) *Attorney, Agent, or Firm* — Matthias Scholl P.C.; Matthias Scholl

(57) ABSTRACT

A cooling device for a vehicle, comprising a fan comprising an input end and a power supply, a transmission box having an input end, a universal joint coupling having an input end and a pulley; wherein the input end of the transmission box is connected to the universal joint coupling, the input end of the universal joint coupling is connected to the pulley, the input end of the transmission box is connected to a transmission device via the universal joint coupling, the transmission box operates to change an angle between a movement center line of the power supply and that of the fan.

17 Claims, 5 Drawing Sheets

COOLING DEVICE FOR VEHICLE

CROSS-REFERENCE TO RELATED APPLICATIONS

This application is a continuation of International Patent Application No. PCT/CN2007/002673, with an international filing date of Sep. 10, 2007, designating the United States, now pending, which is based on China Patent Application No. 200610166571.8, filed Dec. 30, 2006. The contents of these specifications, including any intervening amendments thereto, are incorporated herein by reference.

BACKGROUND OF THE INVENTION

1. Field of the Invention

The invention relates to a cooling device, and particularly to a cooling device for a vehicle.

2. Description of the Related Art

Nowadays, cooling devices are widely used in vehicles, and fans are of great importance for the cooling devices. However, due to space limitation of vehicles, conventional fans are of small size, which greatly affects heat emission effect.

SUMMARY OF THE INVENTION

In view of the above-described problems, it is an objective of the invention to provide a cooling device for a vehicle that features a large-size fan and improved heat emission effect.

To achieve the above objective, in accordance with one aspect of the present invention, there is provided a cooling device for a vehicle, comprising a fan comprising an input end and a power supply, a transmission box having an input end, a universal joint coupling having an input end and a pulley; wherein the input end of the transmission box is connected to the universal joint coupling, the input end of the universal joint coupling is connected to the pulley, the input end of the transmission box is connected to a transmission device via the universal joint coupling, the transmission box operates to change an angle between a movement center line of the power supply and that of the fan.

In another class of this embodiment, the input end of the transmission box is connected to the power supply.

In another class of this embodiment, the input end of the transmission box is connected to a transmission device and then to the power supply.

In another class of this embodiment, the transmission device is a belt transmission device.

In another class of this embodiment, connection between the input end of the transmission box and the transmission device or that between the input end of the transmission box and the power supply is flexible connection.

In another class of this embodiment, connection between the input end of the transmission box and the transmission device or that between the input end of the transmission box and the power supply is implemented by the universal joint coupling.

In another class of this embodiment, an oil pump is connected to an end shaft of the transmission box.

In another class of this embodiment, the universal joint coupling is a cage coupling.

In another class of this embodiment, a bevel gear transmission operating to change the angle between a movement center line of the power supply and that of the fan.

In another class of this embodiment, an output end of the bevel gear transmission is connected to an input shaft of the fan.

In another class of this embodiment, the bevel gear transmission employs circular bevel gear transmission.

In another class of this embodiment, an angle of a bevel gear of the bevel gear transmission is the angle between a movement center line of the power supply and that of the fan.

In another class of this embodiment, the transmission box comprises a housing, at least one stage gear transmission is disposed in the housing, and an output shaft of the gear transmission is connected to the bevel gear transmission.

In another class of this embodiment, a transition gear is connected between two gears of the gear transmission.

In another class of this embodiment, an oil pump is connected to an end shaft of the transmission box.

In another class of this embodiment, an oil pipe is connected between the oil pump and an oil box.

In another class of this embodiment, an output oil pipe of the oil pump is connected to the housing of the transmission box.

The cooling device for a vehicle that features a large-size fan and improved heat emission effect.

BRIEF DESCRIPTION OF THE DRAWINGS

The invention is described hereinafter with reference to accompanying drawings, in which.

DETAILED DESCRIPTION OF THE EMBODIMENTS

Figure 1:
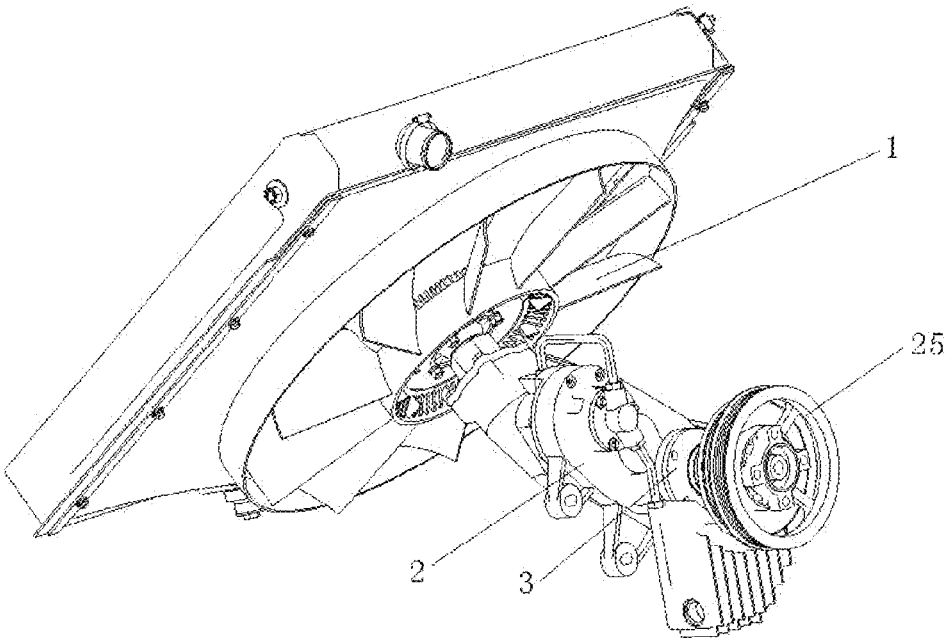
FIG. 1 is a schematic view of a cooling device for a vehicle of an exemplary embodiment of the invention.
Figure 2:
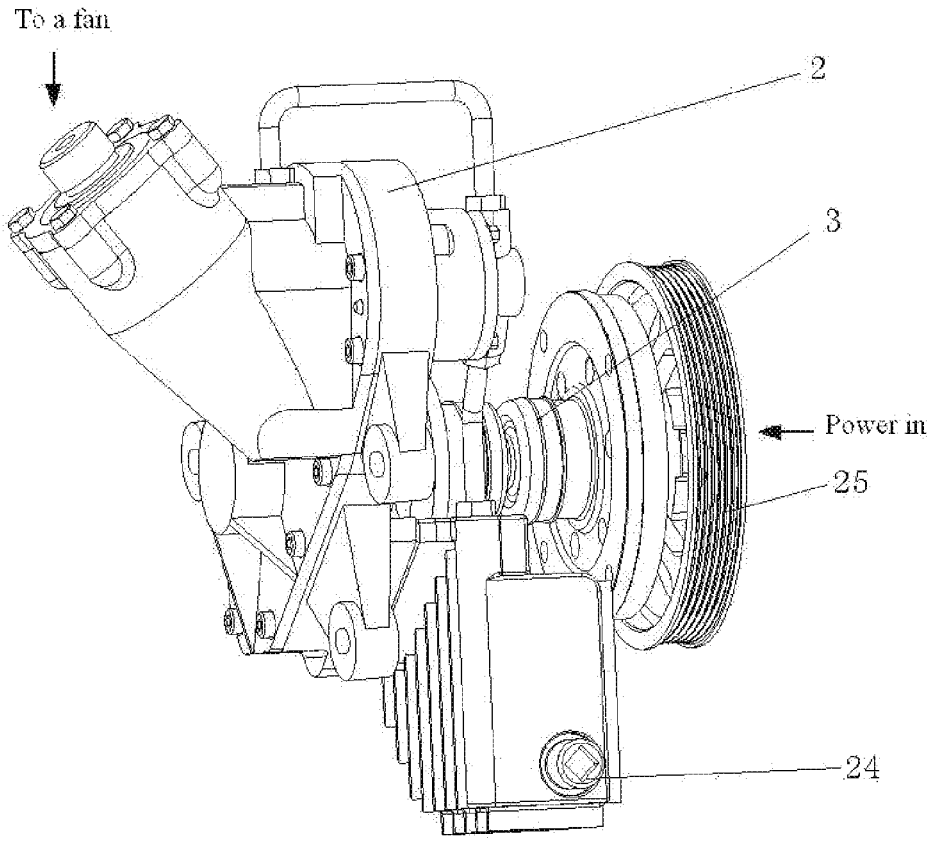
FIG. 2 is a schematic view of a transmission box of an exemplary embodiment of the invention.
Figure 3:
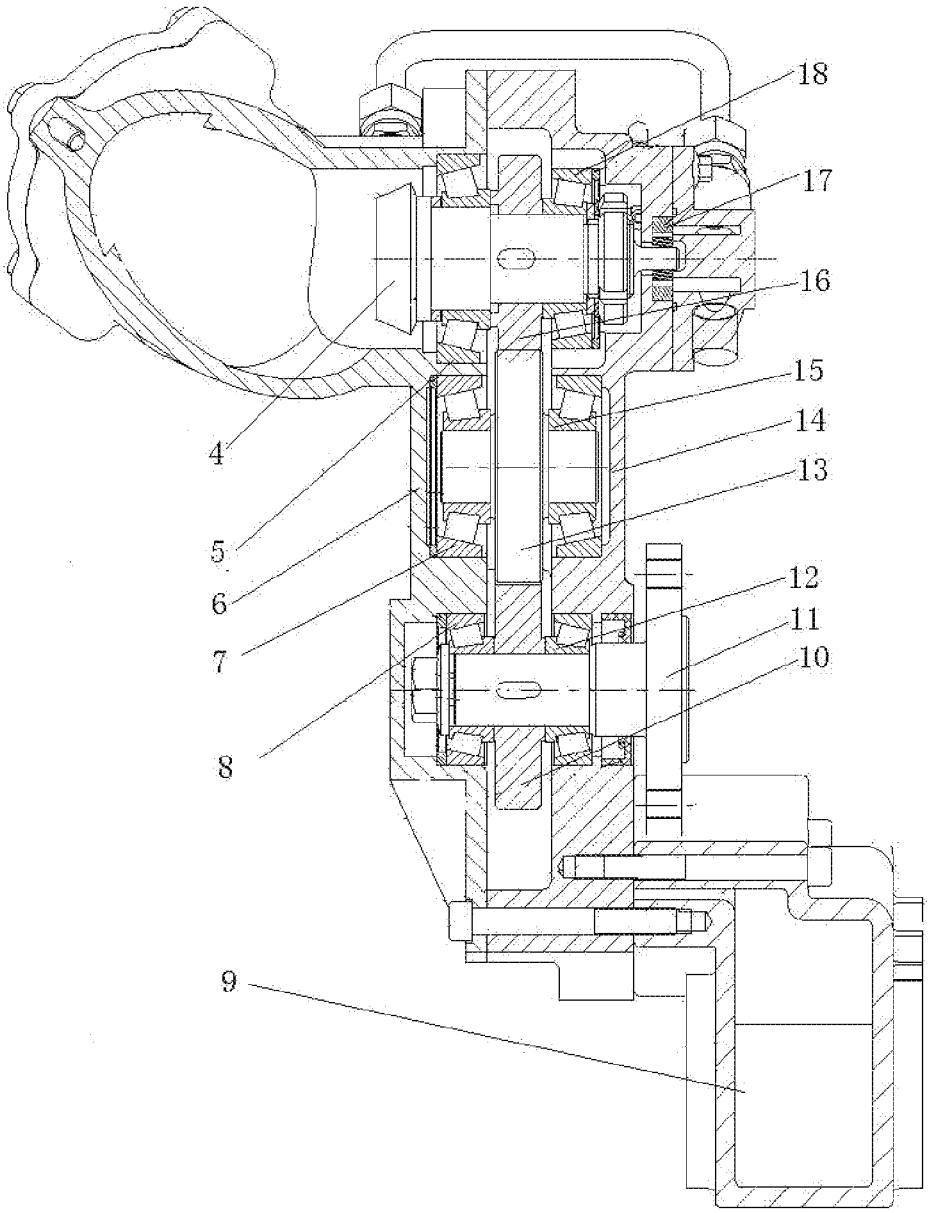
FIG. 3 is a cross-sectional view of a transmission box of an exemplary embodiment of the invention.

As shown in FIGS. 1-3, a cooling device for a vehicle of the invention comprises a fan 1 having a power supply, a transmission box 2, a universal joint coupling 3 and a pulley 25.

In this embodiment, the fan 1 is a silicon oil fan having a diameter of 600 mm.

The transmission box 2 operates to change an angle between a movement center line of the power supply and that of the fan 1. An output shaft of the transmission box 2 is connected to an input shaft of the fan 1.

Connection between the input end of the transmission box 2 and a transmission device or that between the input end of the transmission box 2 and the power supply is flexible connection implemented by a universal joint coupling 3. Flexible connection enables two connected components to move with respect to each other in a certain range, so as to prevent damage or improper operation of the components.

The universal joint coupling 3 may be a cross-shaft-type coupling, a dual-servo coupling, a three-pin axle coupling, a cage coupling and so on. In this embodiment, a cage coupling is used.

An input end of the transmission box 2 is connected to the universal joint coupling 3, and an input end of the universal joint coupling 3 is connected to the pulley 25. Power of an engine is transmitted to the transmission box 2 via the pulley 25.

An oil box 9 is disposed on the transmission box 2, and an oil drain plugis disposed below the oil box 9. The oil box 9 can be integrated with a housing of the transmission box 2 or independent therefrom.

A bevel gear transmission is disposed in the transmission box 2, and operates to change the angle between a movement center line of the power supply and that of the fan. An output end of the bevel gear transmission is connected to the input shaft of the fan 1. In this embodiment, the bevel gear transmission employs circular bevel gear transmission.

The transmission box 2 comprises a housing, at least one stage gear transmission is disposed in the housing, and an output shaft of the gear transmission 2 is connected to the bevel gear transmission.

The circular bevel gear transmission can be disposed in the transmission box 2, or the transmission box 2 can be connected to the circular bevel gear transmission via at least one stage gear.

As shown in FIG. 3, the housing of the transmission box 2 comprises a left housing 6 and a right housing 14. The oil box 9 is disposed below the transmission box 2, and is connected to the housing via a bolt 30.

An input shaft 11 of the gear transmission is supported by a first bearing 8 and a second bearing 12. A driving gear 10 is connected to the input shaft 11, and engaged with a transition gear 13. The transition gear 13 is disposed on a central axis 28. Both ends of the central axis 28 are connected to a supporting bearing 15. A driven gear 16 is disposed on an end shaft 29. Both ends of the end shaft 29 are connected to another supporting bearing 18 and a third bearing 5.

A driving circular bevel gear 4 is disposed on the end shaft 29. The driving circular bevel gear 4 can be integrated with the end shaft 29 or independent therefrom.

As shown in FIG. 3, an oil pump 17 is connected to the end shaft 29. In other embodiments, the oil pump 17 can be connected to other transmission shafts. An oil pipe 31 is connected between the oil pump 17 and the oil box 9. An output oil pipe 32 of the oil pump 17 is connected to the housing of the transmission box 2.

Figure 4:
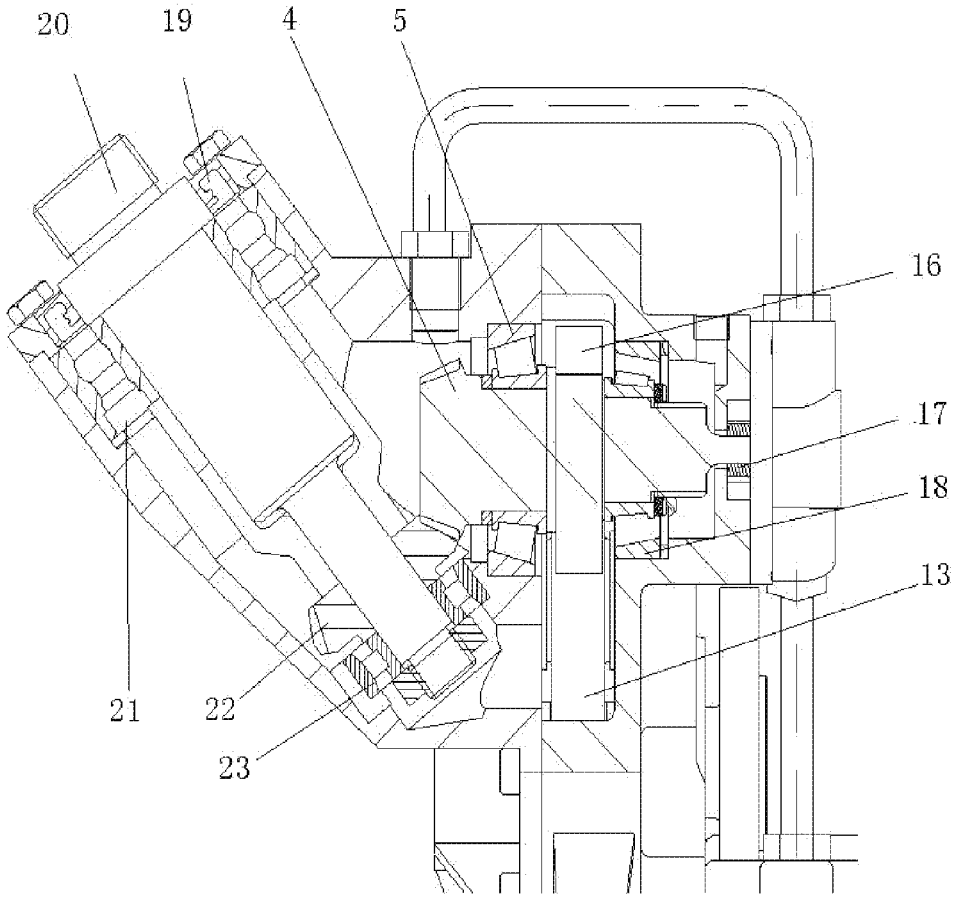
FIG. 4 is another cross-sectional view of a transmission box of an exemplary embodiment of the invention.
Figure 5:
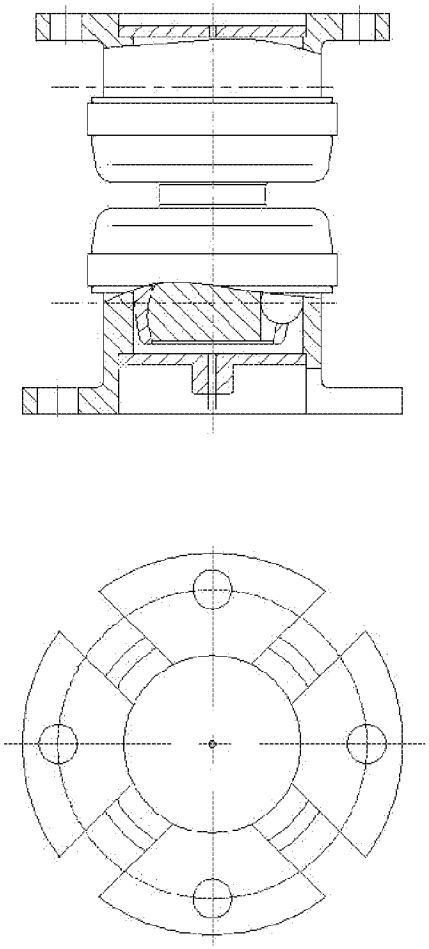
FIG. 5 is a schematic view of a retractable cage coupling of an exemplary embodiment of the invention.

As shown in FIG. 4, a driven circular bevel gear 22 is connected to the output shaft 20. The driving circular bevel gear 4 is engaged with the driven circular bevel gear 22. In this embodiment, the driving circular bevel gear 4 and the driven circular bevel gear 22 employs arc circular bevel gear. An angle between spiral bevel gears of the bevel gear transmission is the angle between a movement center line of the power supply and that of the fan 2. Both ends of the output shaft 20 are connected to a pair of supporting bearings 21 and 23.

An oil seal 19 is disposed between the output shaft 20 and the housing, and another oil seal 33 is disposed between the input shaft 11 and the housing.

Flexible connection between the input end of the transmission box 2 and the transmission device effectively prevents damage of components. The oil box and the oil pump improve lubrication and heat emission during high-speed operation of the engine. In addition, the circular bevel gear transmission greatly reduce noise during transmission.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification, and following claims.

The invention claimed is:

1. A cooling device for a vehicle, comprising a fan comprising an input end and a power supply;

a transmission box having an input end;

a universal joint coupling having an input end; and a pulley;

wherein said input end of said transmission box is connected to said universal joint coupling;

said input end of said universal joint coupling is connected to said pulley;

said input end of said transmission box is connected to a transmission device via said universal joint coupling; and said transmission box operates to change an angle between a movement center line of said power supply and that of said fan.

2. The cooling device for a vehicle of claim 1, wherein said input end of said transmission box is connected to said power supply.

3. The cooling device for a vehicle of claim 1, wherein said input end of said transmission box is connected to the transmission device and then to said power supply.

4. The cooling device for a vehicle of claim 1, wherein connection between said input end of said transmission box and said transmission device or that between said input end of said transmission box and said power supply is flexible connection.

5. The cooling device for a vehicle of claim 1, wherein a bevel gear transmission operating to change the angle between a movement center line of said power supply and that of said fan is disposed in said transmission box.

6. The cooling device for a vehicle of claim 3, wherein said transmission device is a belt transmission device.

7. The cooling device for a vehicle of claim 4, wherein connection between said input end of said transmission box and said transmission device or that between said input end of said transmission box and said power supply is implemented by said universal joint coupling.

8. The cooling device for a vehicle of claim 7, wherein an oil pump is connected to an end shaft of said transmission box.

9. The cooling device for a vehicle of claim 7, wherein said universal joint coupling is a cage coupling.

10. The cooling device for a vehicle of claim 5, wherein an output end of said bevel gear transmission is connected to an input shaft of said fan.

11. The cooling device for a vehicle of claim 10, wherein said bevel gear transmission employs circular bevel gear transmission.

12. The cooling device for a vehicle of claim 10, wherein an angle of a bevel gear of said bevel gear transmission is the angle between a movement center line of said power supply and that of said fan is disposed in said transmission box.

13. The cooling device for a vehicle of claim 10, wherein said transmission box comprises a housing;

at least one stage gear transmission is disposed in said housing; and an output shaft of said gear transmission is connected to said bevel gear transmission.

14. The cooling device for a vehicle of claim 13, wherein a transition gear is connected between two gears of said gear transmission.

15. The cooling device for a vehicle of claim 13, wherein an oil pump is connected to an end shaft of said transmission box.

16. The cooling device for a vehicle of claim 15, wherein an oil pipe is connected between said oil pump and an oil box.

17. The cooling device for a vehicle of claim 13, wherein an output oil pipe of an oil pump is connected to said housing of said transmission box.

* * * * *